US010562044B2

(12) United States Patent
Sunshine

(10) Patent No.: US 10,562,044 B2
(45) Date of Patent: Feb. 18, 2020

(54) SHOWER HEAD ASSEMBLY

(71) Applicant: Steve Sunshine, New York, NY (US)

(72) Inventor: Steve Sunshine, New York, NY (US)

( * ) Notice: Subject to any disclaimer, the term of this patent is extended or adjusted under 35 U.S.C. 154(b) by 46 days.

(21) Appl. No.: 14/902,735

(22) PCT Filed: Jun. 2, 2014

(86) PCT No.: PCT/US2014/040498

§ 371 (c)(1),
(2) Date: Jan. 4, 2016

(87) PCT Pub. No.: WO2015/002713

PCT Pub. Date: Jan. 8, 2015

(65) Prior Publication Data

US 2017/0320073 A1 Nov. 9, 2017

Related U.S. Application Data

(60) Provisional application No. 61/842,941, filed on Jul. 3, 2013.

(51) Int. Cl.
*B05B 1/18* (2006.01)
*B05B 15/50* (2018.01)
(Continued)

(52) U.S. Cl.
CPC ..... *B05B 1/185* (2013.01); *B05B 1/30* (2013.01); *B05B 15/50* (2018.02); *B05B 15/40* (2018.02); *E03C 1/046* (2013.01)

(58) Field of Classification Search
CPC .. B05B 1/18; B05B 1/185; B05B 1/30; B05B 15/02028; B05B 15/02; E03C 1/046;
(Continued)

(56) References Cited

U.S. PATENT DOCUMENTS 1,751,524 A * 3/1930 Moss ..... E03C 1/046 239/315
2,435,510 A 2/1948 Rabjohn
(Continued)

FOREIGN PATENT DOCUMENTS

CN 201168657 Y 12/2008
DE 202009018152 U1 4/2011
JP 63-039653 A 2/1988

OTHER PUBLICATIONS

Office Action for corresponding Japanese Patent Application No. 2016-523755 dated Mar. 18, 2019 (with English translation, 7 pages total).

(Continued)

*Primary Examiner* — Alexander M Valvis
*Assistant Examiner* — Joseph A Greenlund
(74) *Attorney, Agent, or Firm* — Hoffmann & Baron, LLP

(57) ABSTRACT

A shower head is disclosed that includes means for accessing its interior. A method for accessing the interior of the shower head is also disclosed. The shower head includes a main body with an interior, a proximal water receiving end for connecting to a water source and a distal water dispensing end. A face plate is movably affixed to the water dispensing end. The face plate has openings for water to pass therethrough to reach a user. The face plate is movable between a closed position where the face plate closes the distal water dispensing end of the main body and an open position where the face plate is displaced away from the distal water dispensing end of the main body to access the interior of the main body. The interior of the shower head is therefore easily accessible without the need for tools or plumbing expertise. The shower head may include a regulating device, also easily accessible, for controlling the flow or for treating the water passing therethrough.

12 Claims, 5 Drawing Sheets

(51) Int. Cl.
*B05B 1/30* (2006.01)
*B05B 15/40* (2018.01)
*E03C 1/046* (2006.01)

(58) Field of Classification Search
CPC .... B65D 2251/1025; B65D 2251/1016; B65D 2251/105
USPC ..... 220/833–835; 239/589, 34–60
See application file for complete search history.

(56) References Cited

U.S. PATENT DOCUMENTS 2,878,066 A * 3/1959 Erwin ..... B05B 3/04 239/381
2,975,980 A * 3/1961 Siebert ..... B05B 1/18 239/316
2,986,340 A * 5/1961 Webb ..... E03C 1/08 239/315
3,008,650 A * 11/1961 Prokop, Sr. ..... B05B 1/18 239/315
3,018,969 A * 1/1962 Gentry ..... E03C 1/046 239/312
3,367,580 A * 2/1968 Hronas ..... E03C 1/046 239/312
3,402,893 A * 9/1968 Hindman ..... B05B 1/185 239/546
3,762,648 A * 10/1973 Deines ..... B05B 1/1636 239/381
3,788,553 A * 1/1974 Heckman ..... B05B 7/2445 239/315
3,801,019 A * 4/1974 Trenary ..... B05B 1/1636 239/381
3,998,390 A * 12/1976 Peterson ..... B05B 1/083 239/394
4,009,831 A * 3/1977 Arad ..... E03C 1/046 239/315
4,881,575 A 11/1989 Smith
5,862,985 A * 1/1999 Neibrook ..... B05B 1/1636 239/428.5
5,957,387 A * 9/1999 Porta ..... B05B 1/1618 239/310
6,006,374 A * 12/1999 Winnett ..... E03C 1/046 239/312
6,557,782 B1 * 5/2003 Urra ..... B05B 7/2462 239/302
6,776,357 B1 * 8/2004 Naito ..... B05B 1/185 239/533.14
10,240,328 B1 * 3/2019 Estelhomme ..... B05B 7/2462
2009/0101733 A1 * 4/2009 Popov ..... B05B 1/1636 239/310
2010/0040774 A1 * 2/2010 Russell ..... A61H 33/60 427/154
2011/0056015 A1 * 3/2011 Perrin ..... A61H 35/02 4/620
2014/0291419 A1 * 10/2014 Pitsch ..... B05B 1/169 239/437
2016/0303587 A1 * 10/2016 Zhou ..... B05B 3/04
2017/0252755 A1 * 9/2017 Pitsch ..... B05B 1/169
2017/0320073 A1 * 11/2017 Sunshine ..... B05B 1/185

OTHER PUBLICATIONS

European Search Report for corresponding European Patent Application No. 14819621.5, dated Feb. 15, 2017 (7 pages).

* cited by examiner

SHOWER HEAD ASSEMBLY

CROSS REFERENCE TO RELATED APPLICATIONS

The present application is a National Stage Application claiming the priority of PCT Application No. PCT/US2014/040498, filed Jun. 2, 2014, which in turn, claims priority from U.S. Provisional Application No. 61/842,941, filed Jul. 3, 2013. Applicant claims the benefits of 35 U.S.C. § 120 as to the PCT application and priority under 35 U.S.C. § 119 as to the said provisional application, and the entire disclosures of both applications are incorporated herein by reference in their entireties.

BACKGROUND

The present invention relates to a shower head having ready accessibility to the interior thereof, and, more particularly, to a shower head having an interior that can be easily accessed through its distal end for cleaning, repair and the like.

There are many different types and designs of shower heads that connect to a source of water, normally a water pipe, and which then distribute the water in some predetermined manner and pattern to a person.

One of the difficulties of present shower heads, however, is that, depending on the conditions of the water, there can be a build up of calcium or other particulate materials in the shower head that impair the performance of the shower head and, ultimately, can clog the shower head to the point it is ineffective to direct the flow of water onto the user.

More seriously, the spread of infectious diseases, borne by bacteria and viruses alike, has reached critical levels worldwide. At present, the ability to identify and develop effective counteracting measures for such bacteria and viruses has been overwhelmed by the proliferation of such airborne and waterborne agents. Such agents may be found for example, in the common water supplies that are the source of drinking and bathing water alike.

A particular problem that has yet to be fully appreciated and addressed is the accumulation and spread of such disease causing agents for example, through the faucets and nozzles of bathing facilities, such as showers, sinks and the like. The difficulty is particularly acute in the instance of shower heads, where the disease bearing agents such as mold and the like, can accumulate and proliferate within the head, and will be rapidly and widely dispersed once the shower is activated. As a consequence, the operation of the shower causes the widespread distribution of the disease bearing agents through the shower head.

It is noteworthy that most people would consider that the shower head would not need to be cleaned, and certainly no one would consider replacing the head if it still sprayed (functioned). This demonstrates that the problem noted herein is virtually unknown and unappreciated.

Current shower heads are not designed for disassembly to gain access to the interior of the shower head, particularly when installed in a shower facility. Accordingly, disassembly of the shower head to enter the interior of the unit, for example, to clean and disinfect the unit and/or to remove unwanted and obstructive particulate matter that has accumulated in use, is a difficult matter often requiring the services of a professional such as a plumber. At a minimum, the cleaning of the interior of the shower head requires the services of a person having at least basic skills in plumbing, piping and the like, along with the availability of certain basic plumbing tools. As such, the average person is often faced with a difficult task in cleaning the interior of the shower head to restore it to the normal flow conditions for water passing therethrough.

This is particularly true in facilities where the person having the responsibility to maintain the proper operation of the shower head is elderly and/or has limited abilities to remove the shower head to access the interior thereof to carry out the cleaning process.

Accordingly, current shower heads by their design, provide no means for accessing the interior of the head assembly to clean and sanitize the same and to remove accumulated debris, mold, other disease causing agents, and the like. It would therefore be advantageous to have a shower head that is specially designed and constructed so as to facilitate the access to the interior of the shower head so that the task of cleaning particulate or other matter from the interior of the shower head does not require tools and can be carried out by a person having limited plumbing abilities.

There is moreover a need that exists for the development and use of a shower head that is capable of interior cleaning with reasonable facility, so that disease causing agents can be either removed or prevented from accumulating and growing. It is toward the fulfillment of these objectives, that the present invention is directed.

SUMMARY OF THE INVENTION

Accordingly, the present invention relates to a shower head and method of cleaning the same where the user can easily and without plumbing tools, access the interior of the shower head to carry out various functions that require access to that interior, and just as easily reassemble the shower head for continued use. One function is, of course, the cleaning of the interior of the shower head to remove particulate matter, such as calcium or other unwanted materials, as well as to disinfect the interior and to remove infectious and other disease-causing agents.

The shower head of the present invention comprises a main body having an interior area. The main body has a proximal water receiving end that is adapted to be connected to a source of water, such as a water pipe, and a distal water dispensing end. A face plate is affixed to the distal water dispensing end and the face plate has at least one opening to allow water to pass through the face plate and, in an exemplary embodiment, there can be a plurality of openings to provide an even distribution of water emanating from the face plate to impinge onto the person taking the shower.

The interior of the main body of the shower head may be a direct and unobstructed conduit so that water may pass unimpeded, from the source of water to and through the face plate. Alternatively, there may be a regulating device that is located within the interior of the main body to control or in some way regulate or affect the water passing through the interior of the shower head.

The regulating device may itself be a conventional water saving device or other device commonly used in showers that affect, in some way, the flow or make up of the water from the face plate. It is noted, however, that with the present invention, while the regulating device may itself carry out conventional control of the water, access is readily available to the regulating device and it can be adjusted or removed easily by a person having rudimentary skills in plumbing, and limited dexterity.

As a further alternative embodiment, as indicated, the regulating device may affect the flow of the water passing though the shower head but may also affect the constituents that make up that flow of water by adding or removing a material to the water. As such the regulating device may change the composition, purity or chemistry of the water by adding or removing a component thereto, such as a adding a fragrance, water conditioning component or other material that affects the chemistry of the water. The regulating device may also remove some chemical or physical constituent present in the water as it passes through the shower head, such as a filter to remove minute particles of unwanted impurities and the like.

In any event, access to the interior of the shower head is facilitated for cleaning the interior of the main body or attending, for a variety of purposes, to the regulating device, if one is present, by means of the face plate being movable between a closed position wherein the face plate closes the water dispensing end of the main body, and an open position wherein the face plate is displaced away from the water dispensing end of the main body to provide access to the interior of the main body.

In an exemplary embodiment, the face plate is always affixed in some manner to the main body during its movement between its open and closed positions so that the user is assured that the face plate cannot be inadvertently dropped and consequently damaged. As such, the movement of the face plate may be in a variety of directional motions; that is, the face plate may pivot about a point on the main body along a plane that is parallel to the plane of the open, distal end of the main body, or it may swing outwardly or inwardly about a pivot point. The face plate may also be moved by a sliding motion with respect to the main body.

As an alternative embodiment, the face plate may be adapted for rotatable engagement with the main body. For example, the face plate may be rotatably associated with a frame or support, that in turn, is tethered, such as by a hinge connection, to the main body. In a particular illustrative embodiment, the rotatable portion or face plate component, may threadedly engage corresponding mating threads formed in the main body, such that the user can rotate such face plate component to engage or disengage the corresponding threads in the main body, to free the face plate for movement or to secure the face plate in fluid tight engagement with the said main body. Further alternative engagement means between the face plate and main body according to this embodiment, may comprise a bayonet-type assembly, with one or more pins or projections on the face plate, and corresponding L-shaped slots for the reception and secure engagement of said pins.

These and other features and advantages of the present invention will become more readily apparent during the following detailed description taken in conjunction with the drawings herein.

DETAILED DESCRIPTION OF THE INVENTION

Figure 1:
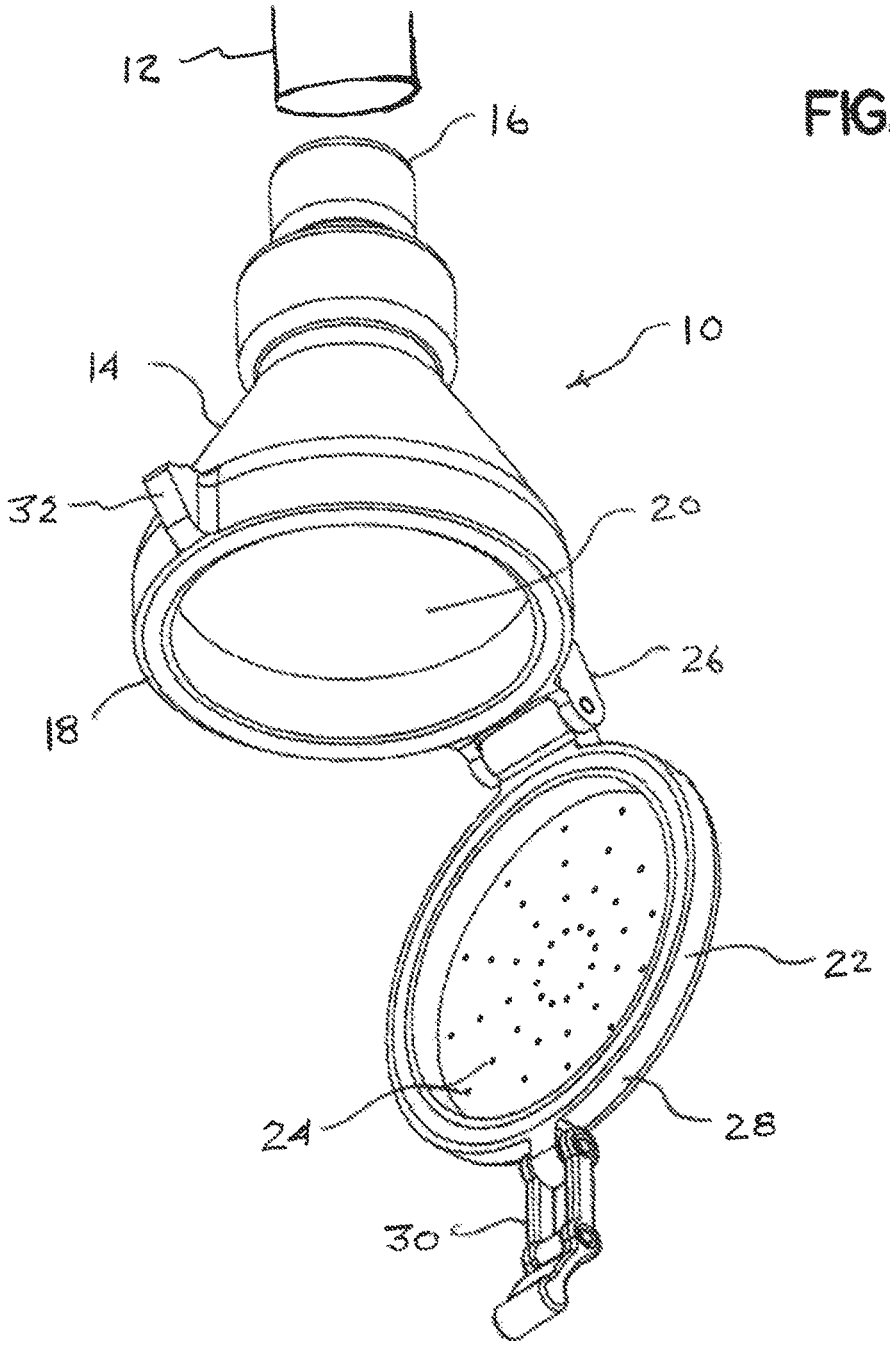
FIG. 1 is perspective view of the shower head of the present invention.

Referring now to FIG. 1 there is shown, a perspective view of a shower head 10 constructed in accordance with the present invention. Thus, the shower head 10 connects to a water pipe 12 that normally is concealed within a wall of the shower to supply water to the shower head 10. As shown, the shower head 10 can threadedly engage the water pipe 12; however, often there is also a swivel joint, such as a ball and socket in the connection that allows the user to move the shower head 10 directionally to change the direction of water flow and to accommodate the desires of the user. Such a joint construction is considered to be a part of the present invention.

The shower head 10 itself is comprised of a main body 14 that has a proximal water receiving end 16 that connects to the water pipe 12 and a distal water dispensing end 18. Within the main body 14 is an interior 20 such that water passes through the interior 20 of the main body 14 in providing water to the user.

A face plate 22 is affixed to the distal water dispensing end 18 and has at least one opening 24 provided therein, and, in the exemplary embodiment of FIG. 1, there are a plurality of such openings 24 that form a spray to exit the shower head 10 and impinge upon the user.

Referring further to FIG. 1, face plate 22 as illustrated is movably mounted on distal water dispensing end 18, and can be moved between a closed position where the face plate 22 fully blocks access to interior 20 through distal water dispensing end 18 of the shower head 10 so that the shower head 10 can be used in its normal function of spraying the water from the water pipe 12 outwardly through the face plate 22 to impinge on the user, and an open position (as shown in FIG. 1) where the face plate 22 is at least partially displaced away from the distal water dispensing end 18 of the shower head 10, thereby making the interior 20 of shower head 10 accessible to the user.

Thus, as shown in the exemplary embodiment of FIG. 1, face plate 22 may be affixed to the main body 14 by means of a hinge 26 that forms a pivot point to allow the face plate 22 to be moved in the manner of a door movable toward and away from full engagement with the distal water dispensing end 18 of the shower head 10. At the free end 28 of the pivotable face plate 22, an illustrative disengageable engagement means such as latch 30 is shown, that may be connected as illustrated, to a hasp 32 on the distal water dispensing end 18 of the shower head 10. As can therefore be seen, the face plate 22 can be unlatched and then pivoted to its open position as depicted in FIG. 1, so that the user can gain full access to the interior 20 of the shower head 10. At this point, the user can access the interior 20 for various purposes, one of which is to carry out the cleaning of interior 20 as described herein. Other uses for the easy access to the interior 20 will be later explained.

It should be understood that alternative engagement means are contemplated and included within the scope of the present invention, so that the particular engagement means shown and described herein are by way of illustration and not limitation. For example, the latch may comprise a reciprocating sliding pin or bolt, not shown herein, that may be mounted against the interior surface of the face plate, and when urged forward, will engage a corresponding slot or depression that may be positioned within the interior wall of the body 14 proximal to face plate 22, to secure and engage the said face plate against the adjacent surface of the body in use. Alternately, one or more spring loaded catches may be disposed along the peripheral edge of the face plate that would be adapted to make releaseable engagement with corresponding detents or channels in the adjacent peripheral edge of the body. In operation, the user would depress the catch or catches to free the face plate to pivot into the open position. Correspondingly, the face plate could be resecured to the body simply by pushing it against the adjacent edge of the body until the catch(es) snap into engagement with the detents therein.

As such, it can be seen that the face plate 22 can be moved between its open and closed positions easily and simply and without the need for tools or expertise in plumbing. Thus, interior 20 can therefore be accessed by persons such as the elderly or by any person having a minimum of manual dexterity.

The latch 30 and hasp 32 elements described above, may be conventional latching elements, including a quick release type of latch such as that useful, for example, in systems for providing quick access to the gas tanks of a racing automobile. Also, and as described earlier, an alternate latching element may comprise a slide bolt-like assembly, or the like, adapted for manual pivoting between a open position where the face plate may move away from the body, and a closed position in which the bolt engages a corresponding mating slot or depression in the body, to lock the face against the body in use.

Further, with all of the constructions described above, a sealing means such as a flexible gasket or the like, (not shown), may be disposed on the peripheral edges of either face plate 22 or dispensing end 18, that make contact each with the other when the shower head is in the closed, operational position, and the interior 20 is thereby inaccessible.

Figure 2:
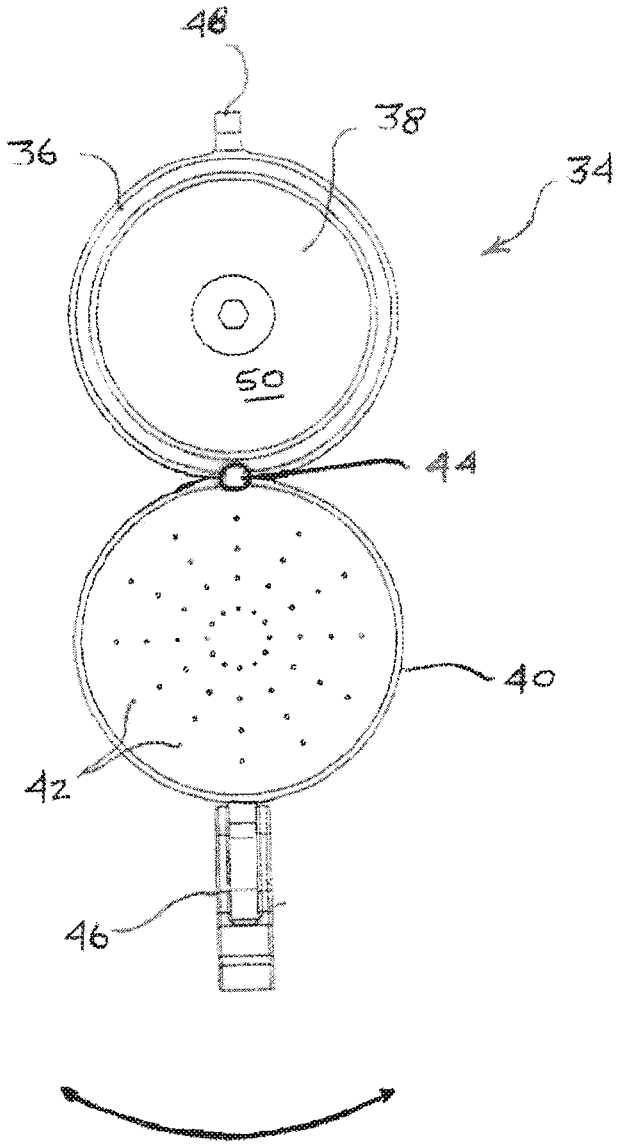
FIG. 2 is an end view of an alternate embodiment of the shower head of FIG. 1.

Turning now to FIG. 2, there is shown, an end view of an alternate embodiment of a shower head 34 constructed in accordance with the present invention. In FIG. 2, the distal water dispensing end 36 of the main body 38 is illustrated as well as the face plate 40 having the openings 42 to guide the water that emanates therefrom. In this embodiment, the face plate 40 may rotate as indicated by the directional arrow appearing below latch 46, about a single pivot point established by pin 44 or a like pivoting device that thereby rotatably affixes the face plate 40 to the main body 38. As can be seen, interlocking latches 46, 48 are also provided on the face plate 40 and main body 38, respectively, to secure the face plate 40 to the main body 38 when the face plate 40 is in its closed position. Likewise, and as described above, various alternate mechanisms to illustrated latches 46, 48 may be employed instead. The face plate 40 is thus rotated to its open position (as shown in FIG. 2) by moving in a plane that is parallel to the plane of the distal water dispensing end 36 of the shower head 34.

Again, as with the FIG. 1 embodiment, it can be seen that a user having minimal skills and no tools can simply and easily gain access to the interior 50 of the shower head 34, without concern that the face plate will disengage from the body of the shower head and either fall and break, or fall and possibly strike and injure the user.

Figure 3:
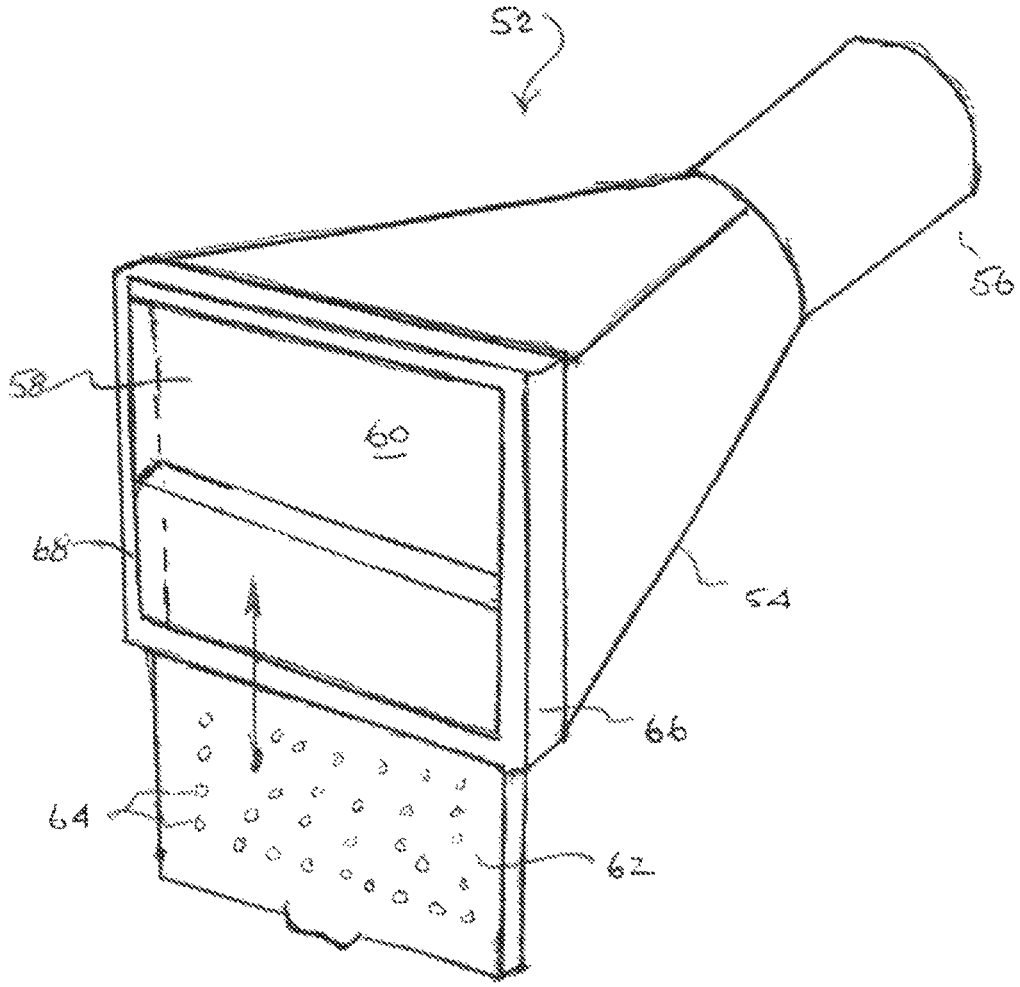
FIG. 3 is a perspective view of an alternate embodiment of the shower head of FIG. 1.

Turning then to FIG. 3, there is shown a still further alternative embodiment of a shower head 52 constructed in accordance with the present invention. Thus as shown, the shower head 52 is comprised of a main body 54 that has a proximal water receiving end 56 and a distal water dispensing end 58. In this embodiment, the distal water dispensing end 58 is rectangular. The main body 54 has an interior 60 such that water passes through the interior 60 of the main body 54 in delivering the water to the user.

The face plate 62 in the FIG. 3 embodiment has openings 64 and slides with respect to the distal water dispensing end 58 of the main body 54 and is set in a frame 66 having an outer flange 68 that allows the face plate 62 to slide while still maintaining its affixation with the main body 54. As such, it can be seen that the face plate 62 in this embodiment can be moved between a closed position where the face plate 62 is completely contained within frame 66 and fully engages the distal water dispensing end 58 of the shower head 52 so that the shower head 52 can be used in its normal function of spraying the water outwardly through the face plate 62 to impinge on the user, and an open position (as shown in FIG. 3) where the face plate 62 is at least partially withdrawn from frame 66 and is displaced away from the distal water dispensing end 58 of the shower head 52, thereby making the interior 60 of shower head 52 accessible to the user.

It can likewise be seen that the face plate 62 of FIG. 3, as with the embodiments of FIGS. 1 and 2, can be moved between its open and closed positions easily and simply and without the need for tools or particular expertise in plumbing.

Figure 4:
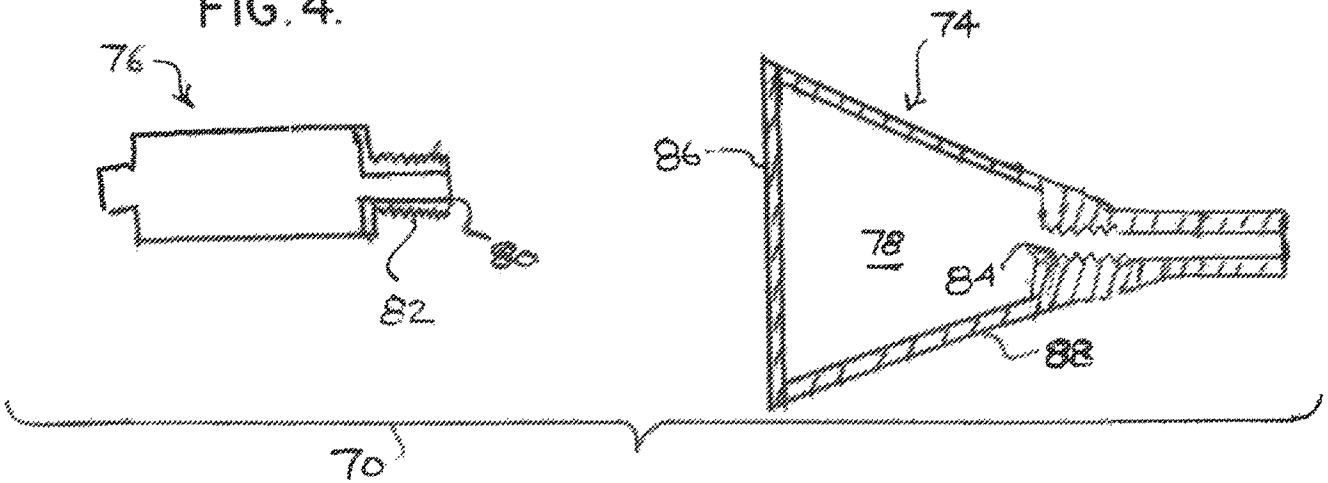
FIG. 4 is an exploded view of the present shower head and illustrating a regulating device that is usable with the present invention.

Turning now to FIG. 4, there is shown an exploded, cross sectional view of a shower head assembly 70 that includes a shower head 74 and a regulating device 76. As can be seen, the regulating device 76 interfits into the shower head 74 to be positioned within the interior 78 thereof. In the exemplary embodiment of FIG. 4, the proximal water receiving end 80 of the regulating device 76 can include releasable engagement means comprising threads 82 that can be rotatably inserted within corresponding threads 84 provided in the interior 78 of the shower head 74, and tightened down therein, thus affixing the regulating device 76 within the shower head 74 in a liquid tight coupling. Alternatively, and as discussed and illustrated herein, the engagement means can comprise one or more pins or projections that are adapted to lock into corresponding channels or tracks in interior 78, in the manner of a bayonet-like mechanism.

From the above, it can be seen that the accessibility to the interior of the shower head that is provided by the use of a movable face plate such as face plate 86, enables regulating device 76 to be readily and easily removable from the main body 88. As previously explained with respect to FIGS. 1-3, access to the interior 78 is readily accomplished such that the regulating device 76 therefore can also be readily accessed for removal, replacement or other purpose. The regulating device 76 may be one of a variety of devices applicable to the shower head 74.

For example, since the regulating device 76 is so easily available for removal, replacement and the like, by a person with minimum plumbing skills, the regulating device may contain perfume or an aromatherapy liquid to be inducted into the stream of water passing through the interior 78 of the shower head 74. With the ease of access, the particular aroma liquid material can be changed, replenished and the like.

Alternatively, the regulating device 76 may be a water conservation device that saves water by reducing the flow of the water emanating from the shower head 74, or may include filtering means to remove particulate matter. The ease of access to the regulating device 76 allows the regulating device to serve a variety of purposes since the user can easily and readily change, alter, or even remove the regulating device 76 by simply accessing the regulating device 76 through the movable face plate 86.

Figure 5:
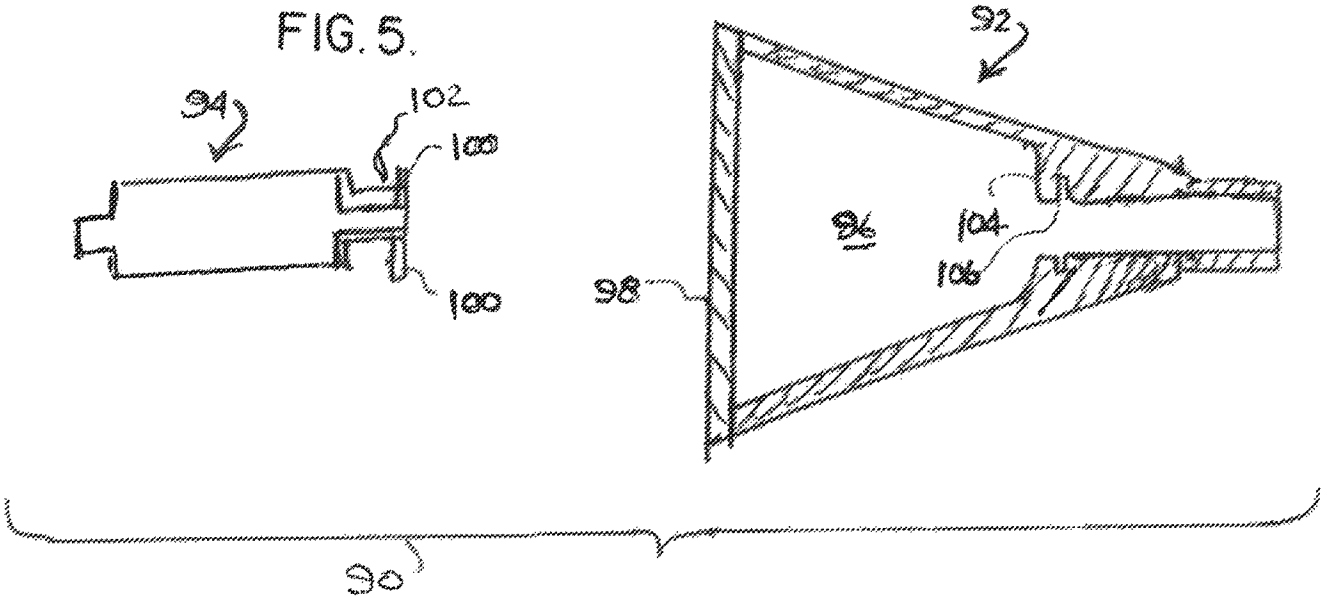
FIG. 5 is an exploded view of the present shower head and illustrating an alternative regulating device of the present invention.

Turning to FIG. 5, there is shown an exploded, cross sectional view of a shower head assembly 90 that includes a shower head 92 and a regulating device 94. Again, as with the FIG. 4 embodiment, the regulating device 94 interfits into the shower head 92 to be positioned within the interior 96 thereof and enclosed in that interior 96 by the removable face plate 98.

In the FIG. 5 embodiment, however, there is at least one, preferably two projections or bayonets 100 located at the proximal water receiving end 102 of the regulating device 94, whereby the locking engagement of regulating device 94 within the shower head 92 is achieved by passing the bayonets 100 through openings (not shown) in an inner flange 104 and, once past the inner flange 104, rotating the regulating device 94 to, in some manner, wedge or locate the bayonets 100 within a bayonet receiving formation, such as at least one corresponding annular recess or slot 106.

Accordingly, the regulating device 94 can be affixed to and just as easily removed from affixation within the shower head 92 by a simple rotation by the user of the regulating device 94 with respect to the shower head 92.

Figure 6:
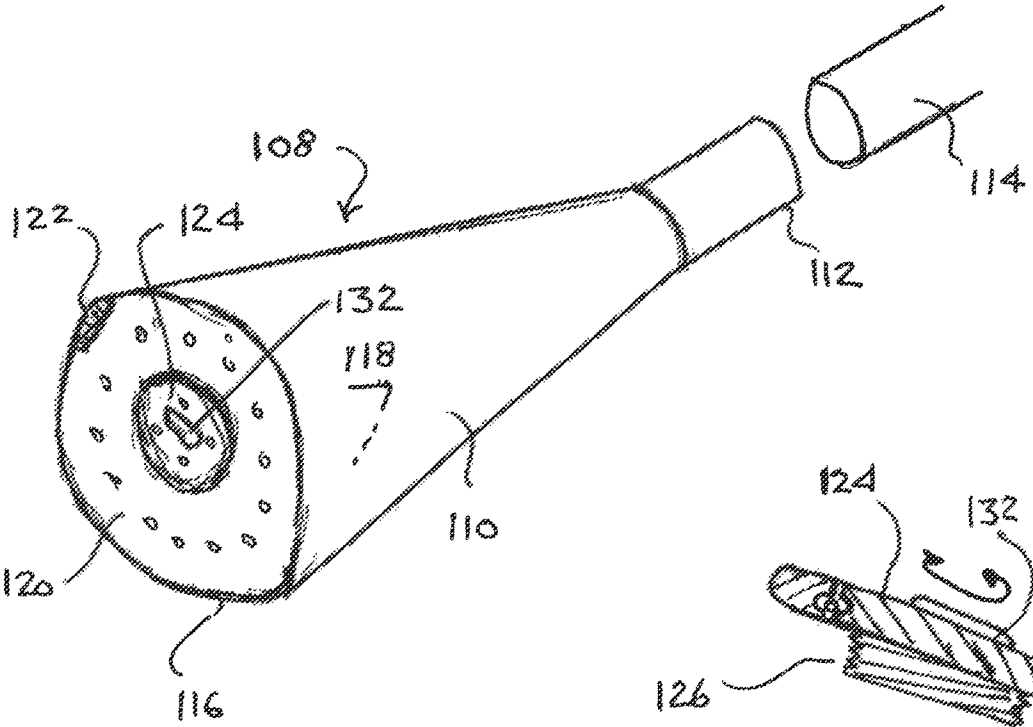
FIG. 6 is a perspective view of an alternative embodiment of the shower head of the present invention.
Figure 7:
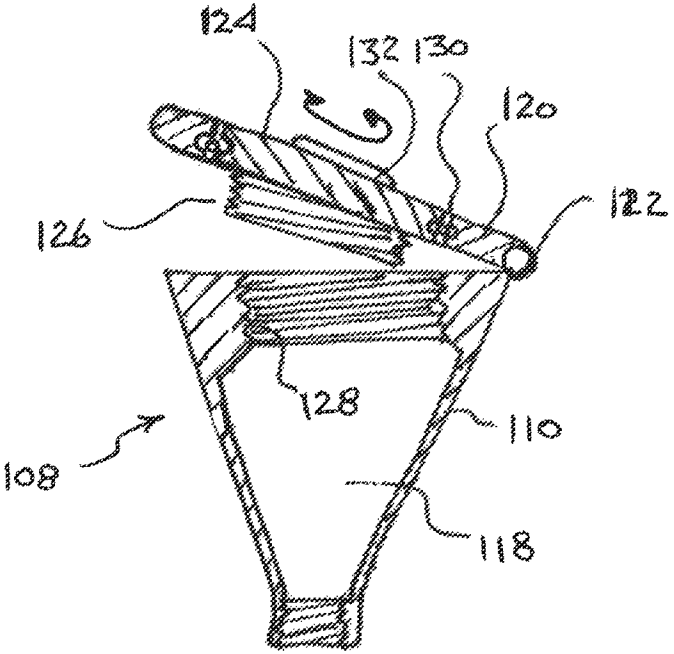
FIG. 7 is a side, cross sectional view of the embodiment of FIG. 6.

Turning then to FIGS. 6 and 7, there are shown a perspective view and a side cross sectional view, respectively, illustrating a further exemplary embodiment of the present shower head 108. Again, the shower head 108 is comprised of a main body 110 that has a proximal end 112 that connects to the water pipe 114 and a distal end 116 from which a water spray is emitted. Within the main body 110 is an interior 118 such that water passes through the interior 118 of the main body 110 in providing water to the user.

With this embodiment, the face plate 120 is affixed to the main body 110 by means of a hinge 122 that forms a pivot point to allow the face plate 120 to be moved in the manner of a door movable toward and away from the distal end 116 of the shower head 108. Again, there is a latching system that is provided to allow the face plate 120 to be freely pivoted about the hinge 122 or retained in its closed position closing of the distal end 116 of the shower head 108.

In this further exemplary embodiment, the face plate 120 comprises an outer annular frame 123 that receives rotatable face plate component 124 that can rotate freely with respect to frame 123. Face plate component 124 is adapted to rotate freely, either clockwise or counterclockwise, with respect to frame 123 in the direction of the double arrow R of FIG. 7. As also can be seen, face plate component 124 has a threaded projection 126 that is threadedly engageable with a corresponding threaded inner wall portion 128 of the main body 110. Accordingly, face plate component 124 can be rotatably received and retained within frame 123. A bearing 130 is shown and may be included, that allows face plate component 124 to rotate while providing a seal to isolate the interior of 118 from the external ambient environment. A projection 132 which may be in the shape of a dial, may be provided on the exterior of the rotatable face plate component 124 to facilitate the user getting a positive grip to carry out the process of rotating the face plate component, to either engage or disengage the face plate from the body.

As therefore can be seen, in the use of the shower head 108 of the FIGS. 6 and 7 embodiment, the face plate 120 can be unlatched by rotating face plate component 124, e.g. in the counterclockwise direction, so that the threaded projection 126 disengages from the corresponding threaded inner wall portion 128 of the main body 110. At that point, the face plate 120 can be pivoted about the hinge 122 to access the interior 118 of the main body 110.

To re-secure the face plate 120 to the main body 110, the reverse is carried out; that is, the face plate component 124 is rotated in the clockwise direction while reengaging the threaded projection 126 to the threaded portion 128 of the main body 110 to again secure the face plate 120 to the main body 110 in a sealed relationship. In an alternative construction within the scope of the invention, the threads disposed on projection 126 and inner wall portion 128, may be replaced with a pin, bolt or other projection, and a channel or slot, respectively, so that the engagement between the face plate component and the body may proceed with a bayonet-type mechanism, such as that described earlier with respect to regulating device 94 in the embodiment of FIG. 5. Accordingly, the invention is intended to include these and other variations within its scope.

Those skilled in the art will readily recognize numerous adaptations and modifications which can be made to the shower head and method of accessing the interior of a shower head of the present invention which will result in an improved shower head and method, yet all of which will fall within the scope and spirit of the present invention as defined in the following claims Accordingly, the invention is to be limited only by the following claims and their equivalents.

What is claimed is:

1. A shower head assembly for direct mounting in the wall of a shower to direct water downwardly on a subject taking a shower, comprising:

a water pipe that is directly mounted in or adjacent said shower wall;

a swivel joint threadingly connected to the water pipe;

a shower head having a main body having an interior, a proximal water receiving end of the shower head threadingly connected to the swivel joint, a distal water dispensing end of the shower head having an open end delimited by a peripheral edge extending there around, and a face plate of the shower head movably affixed to the distal water dispensing end via a hinge, the face plate having a free end opposed from the hinge, the face plate having an interior portion having a plurality of openings to allow water to pass therethrough, the face plate being movable between a fully closed position and an open position, the face plate having a peripheral edge extending the interior portion, wherein, in the fully closed position, the peripheral edge of the face plate is in full engagement with the peripheral edge of said water dispensing end to prevent ingress to the main body, and wherein, in the open position, the peripheral edge of the face plate is fully displaced away from the peripheral edge of the water dispensing end of the main body to provide full access to said shower head interior, wherein, in the fully closed position, said face plate and said water dispensing end are attached to each other and adapted for fluid tight engagement along the entire perimeter of said peripheral edges of said water dispensing end and said face plate, wherein in the closed position of the face plate water is passable from the interior of the main body only through the plurality of openings of the face plate, and wherein the free end of the face plate is releasably engageable with the open end of the main body by means of a quick release latch, the quick release latch comprising a latch rotatably secured to the free end of the face plate and a hasp securably disposed at a portion of the peripheral edge of said water dispensing end, the hasp juxtaposingly disposed with the latch in the fully closed position.

2. The shower head assembly of claim 1, further comprising a water regulating device within the main body adapted to control the movement and/or composition of the water passing through the main body.

3. The shower head assembly as defined in claim 2 wherein the water regulating device is removably affixed to the main body.

4. The shower head assembly as defined in claim 2 wherein the water regulating device has at least one bayonet fitting extending outwardly therefrom, and the main body has a bayonet receiving formation where the water regulating device is attachable and detachable from the main body by the engagement and disengagement of the at least one bayonet fitting with the bayonet receiving formation.

5. The shower head assembly as defined in claim 2 wherein the water regulating device introduces a substance into the water passing through the main body.

6. The shower head assembly as defined in claim 5 wherein the substance is a perfume, a disinfectant, medicament or emollient.

7. A method of accessing the interior of a shower head, the method comprising the steps of:

providing the shower head of claim 1;

moving the face plate to a position at least partially away from the distal water dispensing end while maintaining the face plate affixed to the distal water dispensing end; and accessing the interior of the main body.

8. The method of claim 7 further including the step of moving the face plate to a position covering the distal water dispensing end.

9. The method of claim 7 wherein the step of moving the face plate comprises moving the face plate to fully open the distal water dispensing end.

10. The method of claim 7 wherein the interior of the main body is accessed to clean the interior of the said main body.

11. The method of claim 7 wherein the interior of the main body contain a water regulating device and the main body is accessed to access the said water regulating device.

12. A wall-mounted shower head assembly, consisting of:

a water pipe that is directly mounted in or adjacent a shower wall;

a swivel joint threadingly connected to the water pipe;

a shower head having a main body having an interior;

a proximal water receiving end of the shower head threadingly connected to the swivel joint;

a distal water dispensing end of the shower head having an open end delimited by a peripheral edge extending there around;

a face plate of the shower head movably affixed to the distal water dispensing end via a hinge, the face plate having an interior portion having a plurality of openings to allow water to pass therethrough, the face plate having a peripheral edge extending the interior portion;

a gasket disposed between the face plate and the water displacing end; and a quick release latch having an inter-engaging latch and hasp, the latch rotatably secured to a free end of the face plate at a location opposed from the hinge, and the hasp securably disposed at a portion of the peripheral edge of said water dispensing.

* * * * *